United States Patent [19]

Hull

[11] 4,361,919

[45] Dec. 7, 1982

[54] CONVERTIBLE CHILD'S BED

[76] Inventor: James R. Hull, 148 S. Westgate Ave., Los Angeles, Calif. 90049

[21] Appl. No.: 205,103

[22] Filed: Nov. 10, 1980

[51] Int. Cl.[3] ..... A47D 7/01

[52] U.S. Cl. ..... 5/93 B; 5/2 R

[58] Field of Search ..... 5/93 R, 93 B, 99 B, 5/100, 200 C, 201, 184, 185, 202, 202 R, 202 B, 205; 403/300, 306, 310

[56] References Cited

U.S. PATENT DOCUMENTS

| | | | |
|---|---|---|---|
| 1,776,440 | 9/1930 | Knowles | 5/97 |
| 1,787,805 | 1/1931 | Walter | 5/93 R |
| 2,353,536 | 7/1944 | Abbott et al. | 5/97 |
| 2,355,525 | 8/1944 | Giesler | 5/93 R |
| 2,501,309 | 3/1950 | Braven | 5/93 R |
| 2,564,386 | 8/1951 | Webb | 5/93 R |
| 2,677,832 | 5/1959 | Christensen | 5/201 |
| 3,627,251 | 12/1971 | Paulison | 5/93 R |

FOREIGN PATENT DOCUMENTS

| | | | |
|---|---|---|---|
| 611123 | 3/1935 | Fed. Rep. of Germany | 5/93 R |
| 1476435 | 2/1967 | France | 5/93 R |
| 2429001 | 2/1980 | France | 5/100 |
| 19248 | of 1910 | United Kingdom | 5/100 |

*Primary Examiner*—Roy D. Frazier
*Assistant Examiner*—Michael F. Trettel
*Attorney, Agent, or Firm*—Keith D. Beecher

[57] ABSTRACT

A convertible child's bed is provided which may be sold in the form of a crib for use by the child when it is very young, and which may subsequently be converted into a standard twin bed as the child becomes older.

8 Claims, 9 Drawing Figures

CONVERTIBLE CHILD'S BED

BACKGROUND

The objective of the present invention is to provide a convertible child's bed which may easily be converted from a crib into a standard twin bed, thereby to obviate the situation which normally occurs when a child grows older. Specifically, the convertible bed of the present invention precludes the need to discard the crib, and to purchase a standard size twin bed, as the child outgrows his crib.

DETAILED DESCRIPTION OF THE ILLUSTRATED EMBODIMENTS

Figure 1:
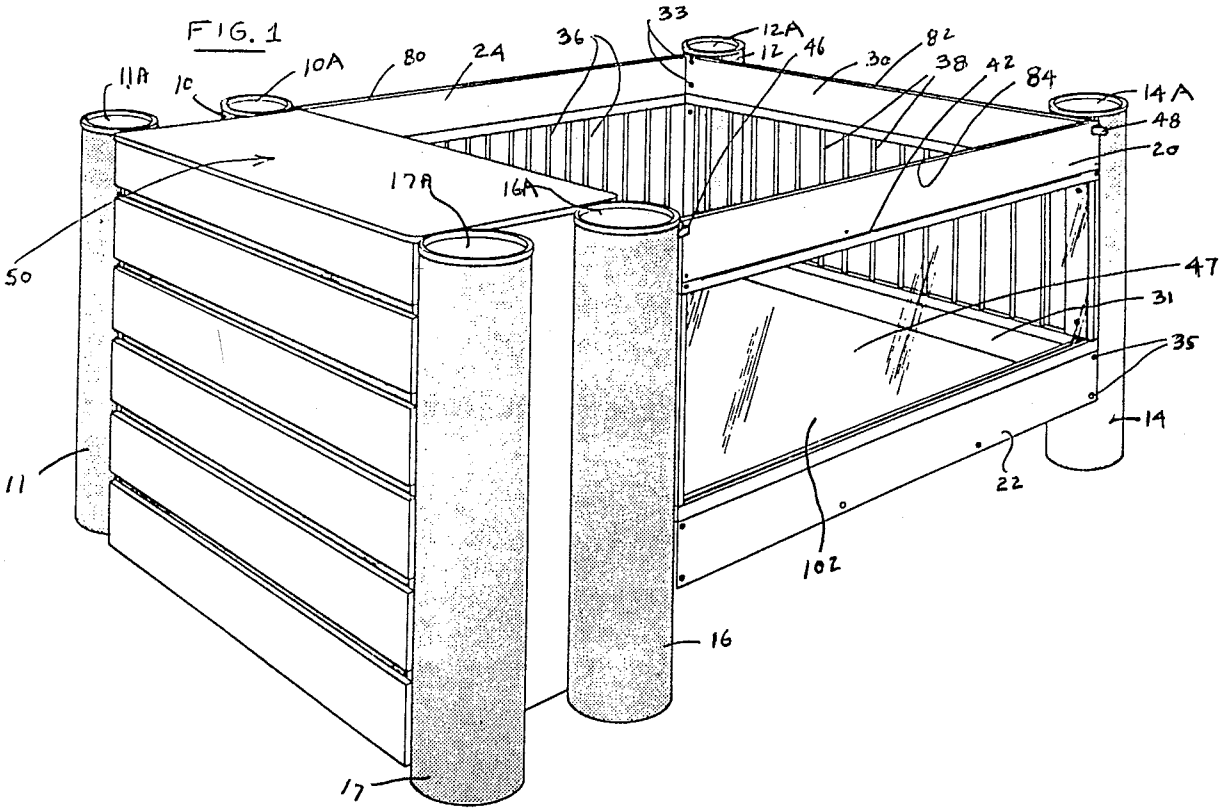
FIG. 1 is a perspective view of one embodiment of the convertible child's bed of the present invention, in the form of a crib, and with an optional dresser/changing table attached to one end of the crib.

The bed shown in FIG. 1 is in the form of a crib. It includes four corner posts 10, 12, 14 and 16. Each of the corner posts in the illustrated embodiment is in the form of an elongated hollow cylinder having an end cap inserted into its upper end, the end caps being designated 10A, 12A, 14A and 16A respectively. A first pair of elongated members, in the form of side rails 20 and 22 extend between the corner posts 14 and 16 in spaced parallel relationship to constitute one side of the crib; and a second pair of elongated side members in the form of side rails, such as rail 24 extend between the posts 10 and 12 in spaced parallel relationship to constitute the opposite side of the crib.

A further pair of elongated members, such as rails 30 and 31 extend in spaced parallel relationship between the posts 12 and 14 to form one end of the bed. These rails are secured to the posts 12 and 14 by appropriate screws such as screws 33. Side rail 22 is attached to one end of rail 31 by screws, such as screws 35; and side rail 24 is attached to rail 30 by similar screws, not shown.

Figure 3:
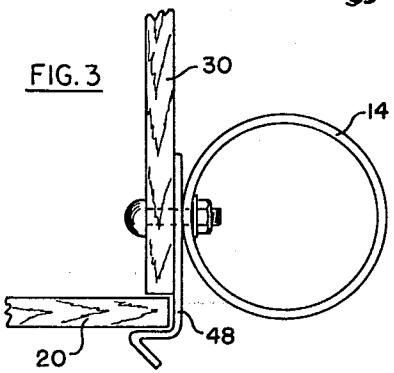
FIG. 3 is an enlarged fragmentary plan view of one corner of the crib of FIG. 1, showing details of a latch which is included in the structure.

A number of vertical rods 36 extend between the upper and lower rails of one side of the bed, and a number of upright rods 38 extend between the upper and lower rails at both ends of the bed. A clear plastic panel 47 extends between the rails 20 and 22 to form the other side of the bed. Rail 20 is hinged to the upper end of the plastic panel 47 by a hinge 42, so as to enable the top rail 20 to be turned down to facilitate access to the interior of the crib. Rail 20 is held in its upright position by resilient clips 46 and 48, clip 48 being shown, for example, on an enlarged scale in FIG. 3, and clip 46 having a similar configuration.

An optional dresser/changing table 50 is secured to posts 10 and 16 to form the other end of the crib, in the embodiment of FIG. 1, the dresser being provided with its own posts 11 and 17 which, like the corner posts of the crib, are formed of elongated hollow cylinders having respective end caps 11A and 17A inserted into the upper ends thereof.

Figure 4:
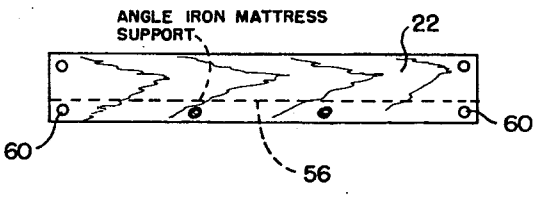
FIG. 4 is a detailed view of a side member of the bed of FIG. 1, showing the manner in which an angle iron mattress support is secured to the inner side of the side member.
Figure 8:
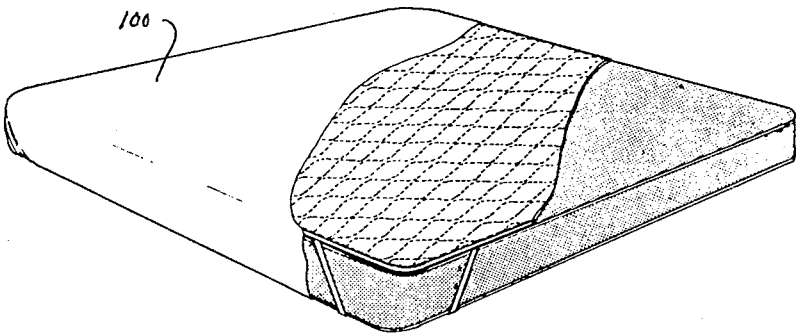
FIG. 8 is a perspective view of a mattress which may be supported on the bottom of the bed shown in FIG. 1 or 6, a similar but elongated mattress being used in the twin beds of FIGS. 2 and 7.

The mattress 100 (FIG. 8) of the crib is supported, for example, on a board 102 (FIG. 1) which, in turn, is supported on angle iron supports which are mounted on the inner sides of the lower side rails of the crib. Such an elongated angle iron support is designated 56 in FIG. 4, and it is secured to the side rail 22 by appropriate screws or bolts 60. It will be appreciated that a similar angle iron support is supported by the lower side rail on the opposite side of the crib.

Figure 2:
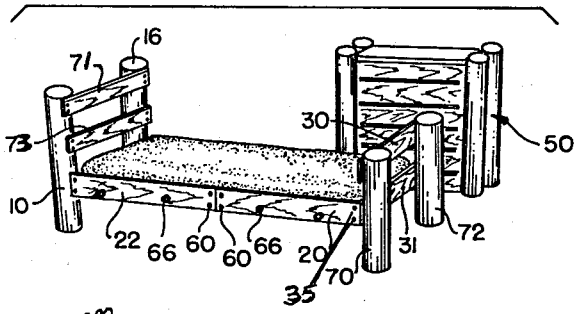
FIG. 2 is a perspective view of the convertible bed of FIG. 1 converted into a twin bed.

To convert the crib of FIG. 1 into the twin bed of FIG. 2, the optional chest 50 can be removed from the corner posts 10 and 16, with the posts 10 and 16 forming the high end of the twin bed, and having end members in the form of rails 71 and 73 attached to the posts, as shown in FIG. 2. The low end of the bed of FIG. 2 is formed by new posts 70 and 72, and by rails 30 and 31 (FIG. 2) which are attached to the posts.

Figure 5:
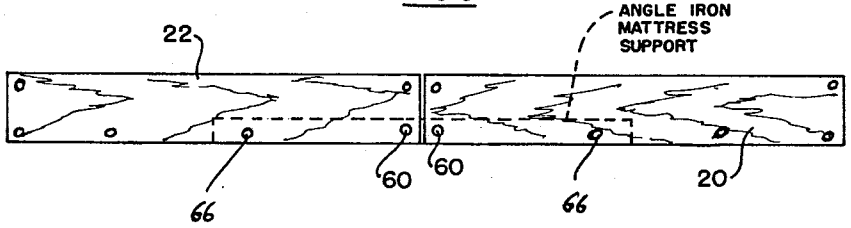
FIG. 5 is a detailed view of two side members used in the bed of FIG. 2, and showing the manner in which the angle iron mattress support may be used to interconnect the two side members, and to hold the side members in rigid abutting end-to-end relationship.

The upper rails 20 and 24 are removed from the crib of FIG. 1, and they are secured to the lower rails in abutting end-to-end relationship, as shown in FIGS. 2 and 5, with the angle iron support 56 serving to secure the two side rails together. The screws 60 are used to hold the angle iron in place, and additional screws 66 are inserted through appropriate holes in the side rails to serve as further securing means for the angle iron support, and to assure that the two side rails will be rigidly held in place.

Figure 9:
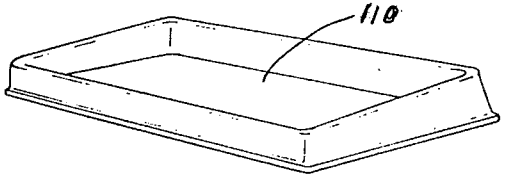
FIG. 9 is a perspective view of a tray which may be placed on the top of the dresser of FIG. 1 for infant changing purposes.

The upper side rail 24 on the other side of the crib is similarly attached to the lower side rail to form the opposite side of the twin bed of FIG. 2. If desired, the dresser 50 may be retained on one end of the twin bed of FIG. 2, to preclude any necessity for obtaining new posts 71 and 73. A tray 110, as shown in FIG. 9, may be mounted on top of the dresser 50, attached to the crib of FIG. 1, to serve as a changing tray for the infant. The tray may be formed, for example, of white molded vacuum formed plastic. Plastic extrusions 80, 82 and 84 (FIG. 1) are secured to the top edges of the upper rails to provide teething members for the infant. A vinyl covered pad may be placed in the tray 110 on top of the dresser 50 to facilitate its changing function.

Figure 6:
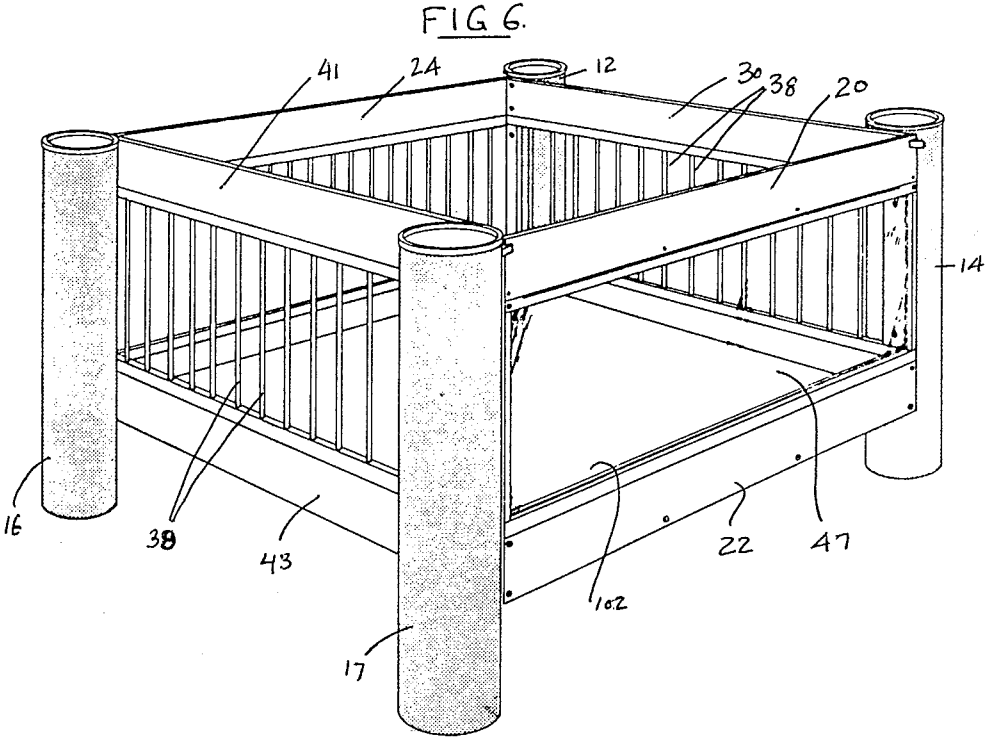
FIG. 6 is a perspective view of a second embodiment of the convertible child's bed of the present invention in the form of a crib, but without the optional dresser/-changing table attached.

The embodiment of FIG. 6 is similar to the embodiment of FIG. 1, and like components have been designated by the same numbers. The latter embodiment, however, does not include the optional dresser 50.

Figure 7:
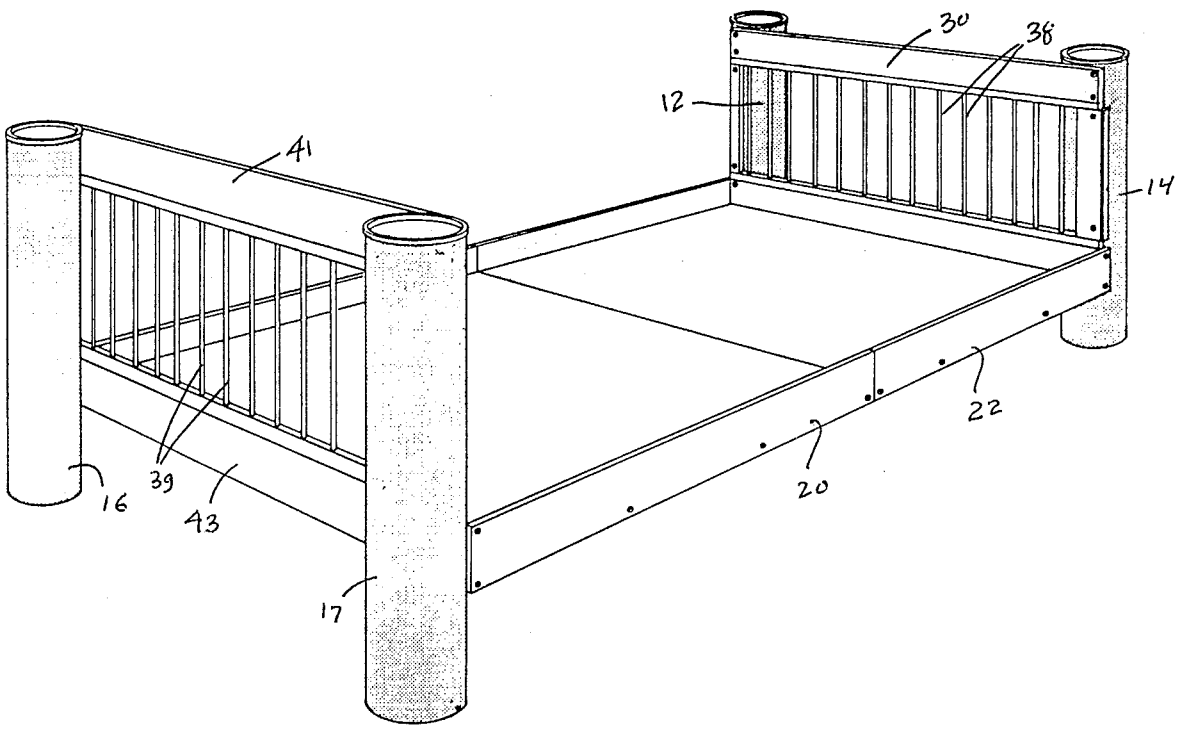
FIG. 7 is a perspective view of the convertible bed of FIG. 6 converted into a twin bed.

The crib of FIG. 6 may be formed into the twin bed of FIG. 7, without any need to order new posts or new ends.

It will be appreciated that while particular embodiments of the convertible child's bed of the present invention have been shown and described, modifications may be made. It is intended in the claims to cover all such modifications which come within the true spirit and scope of the invention.

What is claimed is:

1. A convertible child's bed comprising: four upright corner posts; means including a first pair of elongated rectangular rails removably secured in vertical uniplanar relationship to a first two of the upright corner posts in vertical spaced relationship to form one side of the bed; means including a second pair of elongated rectangular rails removably secured in vertical uniplanar relationship to the other two of the upright corner posts in vertical spaced relationship to form the other side of the bed; first and second elongated mattress support members of essentially the same length as said elongated rectangular rails removably attached to the respective lower elongated rectangular rails of the first and second pairs; and said child's bed being convertible into a youth bed in which the upper elongated rectangular rails of each pair are secured to the corresponding upright corner posts in respective end-to-end abutting relationship with the corresponding lower elongated rectangular rails to permit the bed to be expanded to essentially twice its original length, and said elongated mattress supporting members being attached to the respective abutting rails in bridging relationship therewith to secure the abutting rails to one another, and also to serve as a mattress supporting means.

2. The convertible child's bed defined in claim 1, and which includes a third pair of elongated rectangular rails removably attached to a first and a second of the upright cover posts and vertically spaced from one another to form one end of the bed.

3. The convertible child's bed defined in claim 2, and which includes a plurality of elongated members extending in spaced relationship between the upper and lower elongated rectangular rails of the first and third pairs.

4. The convertible child's bed defined in claim 1, and which includes a clear plastic panel extending between the lower and upper elongated rectangular rails of the first pair.

5. The convertible child's bed defined in claim 4, in which the upper elongated rectangular rail of the first pair is hinged to the plastic panel to enable such upper elongated rectangular rail to be turned down so as to facilitate access to the bed.

6. The convertible child's bed defined in claim 2, and which includes extruded elongated plastic members respectively secured to the upper edges of the upper elongated rectangular rails of the first, second and third pairs.

7. The convertible child's bed defined in claim 2, and which includes a chest secured to the third and fourth upright posts to provide the other end for the bed.

8. The convertible child's bed defined in claim 1, in which said upright corner posts are each in the form of elongated hollow cylindrical members.

* * * * *